US012383045B2

(12) United States Patent
Na et al.

(10) Patent No.: US 12,383,045 B2
(45) Date of Patent: Aug. 12, 2025

(54) PORTABLE BACKPACK VACUUM HAVING FOLD-IN HARNESS

(71) Applicants: Wenxin Na, Marriottsville, MD (US); James Standaloft, Gateshead (GB); Karl Palm, Baltimore, MD (US)

(72) Inventors: Wenxin Na, Marriottsville, MD (US); James Standaloft, Gateshead (GB); Karl Palm, Baltimore, MD (US)

(73) Assignee: STANLEY BLACK & DECKER INC., New Britain, CT (US)

( * ) Notice: Subject to any disclaimer, the term of this patent is extended or adjusted under 35 U.S.C. 154(b) by 351 days.

(21) Appl. No.: 18/066,634

(22) Filed: Dec. 15, 2022

(65) Prior Publication Data

US 2024/0197060 A1 Jun. 20, 2024

(51) Int. Cl.
*A45F 3/14* (2006.01)
*A47L 5/36* (2006.01)

(52) U.S. Cl.
CPC ..... *A45F 3/14* (2013.01); *A47L 5/365* (2013.01); *A45F 2003/146* (2013.01)

(58) Field of Classification Search
CPC ..... A45F 3/14; A45F 2003/146; A47L 5/365
USPC ..... 224/257
See application file for complete search history.

(56) References Cited

U.S. PATENT DOCUMENTS 3,180,545 A * 4/1965 Southwick ..... A45F 3/08 224/263
4,214,685 A * 7/1980 Pletz ..... A45F 3/04 224/634
4,318,502 A * 3/1982 Lowe ..... A45F 3/04 224/642
4,489,866 A * 12/1984 Korte ..... A45F 4/02 224/636
5,161,722 A * 11/1992 Hembree ..... A45F 3/08 224/148.2
5,184,763 A * 2/1993 Blaisdell ..... A45F 3/04 224/583
5,609,278 A * 3/1997 Fresco ..... A45F 4/02 224/582
5,806,741 A * 9/1998 Kirk ..... A45F 5/00 224/665
9,820,555 B2 * 11/2017 Beck ..... A45F 3/14
10,368,626 B2 * 8/2019 Roque ..... A45F 3/04
11,058,210 B2 * 7/2021 Lennings ..... F16M 13/04
11,071,673 B2 * 7/2021 Van Engelhoven ..... A61H 1/0292
2009/0095780 A1 * 4/2009 Wangeby ..... A45F 3/14 224/264
2015/0020345 A1 * 1/2015 Day ..... A47L 9/22 15/347
2019/0174740 A1 * 6/2019 Lambert ..... A01D 43/063
(Continued)

FOREIGN PATENT DOCUMENTS

WO WO-2021233515 A1 * 11/2021 ..... A47L 5/365

*Primary Examiner* — Peter N Helvey
(74) *Attorney, Agent, or Firm* — Jordan IP Law, LLC; Todd A. Vaughn

(57) ABSTRACT

A portable backpack vacuum having a pair of housing members and a fold-in harness member that is pivotably movable relative to an upper housing member between a deployed position when the portable backpack vacuum is in use to a stowed position when the portable backpack vacuum is not in use and a lower housing is removed from the upper housing. In this way, the portable backpack vacuum may stand level on the support surface.

17 Claims, 8 Drawing Sheets

(56) References Cited

U.S. PATENT DOCUMENTS

| | | | | |
|---|---|---|---|---|
| 2020/0375421 | A1* | 12/2020 | Huang | A47L 9/2821 |
| 2023/0084518 | A1* | 3/2023 | Kull | A47L 9/122<br>15/347 |

* cited by examiner

PORTABLE BACKPACK VACUUM HAVING FOLD-IN HARNESS

TECHNICAL FIELD

One or more embodiments set forth, described, and illustrated herein relate to a portable vacuum, and particularly, to a portable backpack vacuum having a fold-in harness that is pivotably movable to a stowed position to facilitate support of the portable backpack vacuum on a support surface when the lower housing is removed from the upper housing.

BACKGROUND

There are known portable backpack vacuums that are wearable by a user using a harness that provides ergonomic comfort to the user during use. The lower housing, after a cleaning sequence has been conducted, must be emptied of its contents by its removal from an upper housing. Removal of the lower housing from the upper housing presents a challenge to the user of the manner in which to support the upper housing and the harness on a support surface.

SUMMARY

One or more embodiments includes a portable backpack vacuum has a pair of housing members and a fold-in harness member that is pivotably movable relative to an upper housing member between a deployed position when the portable backpack vacuum is in use to a stowed position when the portable backpack vacuum is not in use and a lower housing is removed from the upper housing. In this way, the portable backpack vacuum may stand level on the support surface.

In accordance with one or more embodiments, an example portable backpack vacuum comprises one or more of the following: an upper housing; a lower housing detachably connected to the upper housing; and a harness member to facilitate support of the portable backpack vacuum by a user, the harness member including a waist support member that is pivotably connected to the upper housing for rotation from a deployed position to a stowed position by engagement of the waist support member with a support surface when the lower housing is detachably removed from its connection with the upper housing and when the upper housing and the harness member are placed on the support surface.

In accordance with the example portable backpack vacuum, one or more connection members are pivotably connected the waist support member to the upper housing in a manner that facilitates rotation of the waist support member between the deployed position and the stowed position.

In accordance with the example portable backpack vacuum, each connection member in the one or more connection members comprises a flexible connector member operable to facilitate rotation of the waist support member to the stowed position by the engagement of the waist support member with the support surface.

In accordance with the example portable backpack vacuum, each connection member in the one or more connection members comprises a hinge connector member operable to facilitate rotation of the waist support member to the stowed position by engagement of the one or more hinge connector members with the support surface.

In accordance with the example portable backpack vacuum, one or more spring connector members are operable to bias the waist support member towards the stowed position after the engagement of the waist support member with the support surface.

In accordance with the example portable backpack vacuum, the one or more hinge connector members may comprise approximately 90-degree self-locking folding hinges.

In accordance with the example portable backpack vacuum, in the stowed position the waist support member has an orientation that is substantially perpendicular to the support surface.

In accordance with the example portable backpack vacuum, in the stowed position the waist support member is orientated at an acute angle relative to the support surface.

In accordance with the example portable backpack vacuum, the waist support member, during translation from the deployed position to the stowed position, moves between approximately 0 degrees to approximately 90 degrees relative to the support surface.

In accordance with one or more embodiments, an example portable backpack vacuum comprises one or more of the following: a housing; and a harness member to facilitate support of the portable backpack vacuum by a user, the harness member including a waist support member that is pivotably connected to the housing for rotation from a deployed position to a stowed position by engagement of the waist support member with a support surface when the upper housing and the harness member are placed on the support surface.

In accordance with the example portable backpack vacuum, a lower housing is detachably connected to the housing, wherein when the lower housing is detached from the upper housing, the waist support member is rotated to the stowed position by the engagement of the waist support member with the support surface.

In accordance with the example portable backpack vacuum, one or more connection members are pivotably connected the waist support member to the upper housing in a manner that facilitates rotation of the waist support member between the deployed position and the stowed position.

In accordance with the example portable backpack vacuum, each connection member in the one or more connection members comprises a flexible connector member operable to facilitate rotation of the waist support member to the stowed position by the engagement of the waist support member with the support surface.

In accordance with the example portable backpack vacuum, each connection member in the one or more connection members comprises a hinge connector member operable to facilitate rotation of the waist support member to the stowed position by engagement of the one or more hinge connector members with the support surface.

In accordance with the example portable backpack vacuum, one or more spring connector members are operable to bias the waist support member towards the stowed position after the engagement of the waist support member with the support surface.

In accordance with the example portable backpack vacuum, the one or more hinge connector members may comprise approximately 90-degree self-locking folding hinges.

In accordance with the example portable backpack vacuum, in the stowed position the waist support member has an orientation that is generally perpendicular to the support surface.

In accordance with the example portable backpack vacuum, in the stowed position the waist support member is orientated at an acute angle relative to the support surface.

In accordance with one or more embodiments, an example portable backpack appliance comprises one or more of the following: a housing; and a harness member to facilitate support of the housing by a user, the harness member including a waist support member that is pivotably connected to the housing for rotation from a deployed position to a stowed position by engagement of the waist support member with a support surface.

In accordance with the example portable backpack appliance, one or more connection members are operable to pivotably connect the waist support member to the housing in a manner that facilitates rotation of the waist support member between the deployed position and the stowed position.

In accordance with the example portable backpack appliance, each connection member in the one or more connection members comprises a flexible connector member operable to facilitate rotation of the waist support member to the stowed position by the engagement of the waist support member with the support surface.

In accordance with the example portable backpack appliance, each connection member in the one or more connection members comprises a hinge connector member operable to facilitate rotation of the waist support member to the stowed position by engagement of the one or more hinge connector members with the support surface.

In accordance with the example portable backpack appliance, one or more spring connector members operable to bias the waist support member towards the stowed position after the engagement of the waist support member with the support surface.

In accordance with the example portable backpack appliance, the one or more hinge connector members may comprise 90-degree self-locking folding hinges.

In accordance with the example portable backpack appliance, in the stowed position the waist support member has an orientation that is generally perpendicular to the support surface.

DRAWINGS

The various advantages of the exemplary embodiments will become apparent to one skilled in the art by reading the following specification and appended claims, and by referencing the following drawings, in which:

DESCRIPTION

One or more embodiments set forth, described, and illustrated herein relate to a portable backpack vacuum that includes an upper housing that forms a vacuum body, a lower housing that forms a dust tank and which is detachably connected to the upper housing, and a harness member that is pivotably connected to the upper housing to facilitate support of the portable backpack vacuum by a user. The harness member comprises a fold-in harness that is pivotably connected to the upper housing via one or more connection members in a manner that facilitates support of the portable backpack vacuum on a support surface when the lower housing is selectively removed from the upper housing (e.g., in order to remove its contents). In particular, when the lower housing is removed, the harness member is operable to pivot or fold-in relative to the support surface to facilitate support of the upper housing on the support surface.

Figure 1:
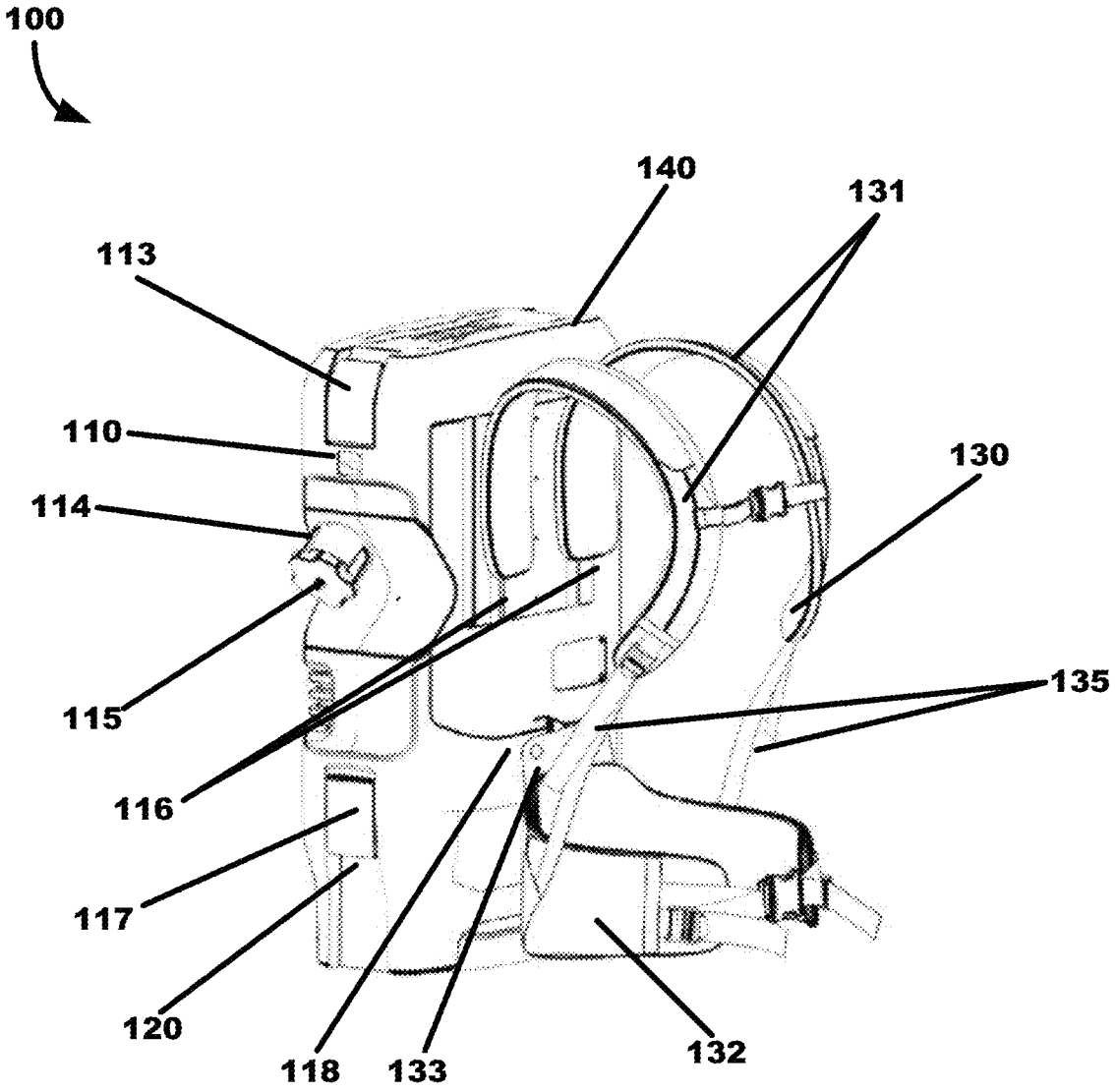
FIG. 1 illustrates a rear, perspective view of an example portable backpack vacuum, in accordance with one or more embodiments set forth, described, and/or illustrated herein.
Figure 2:
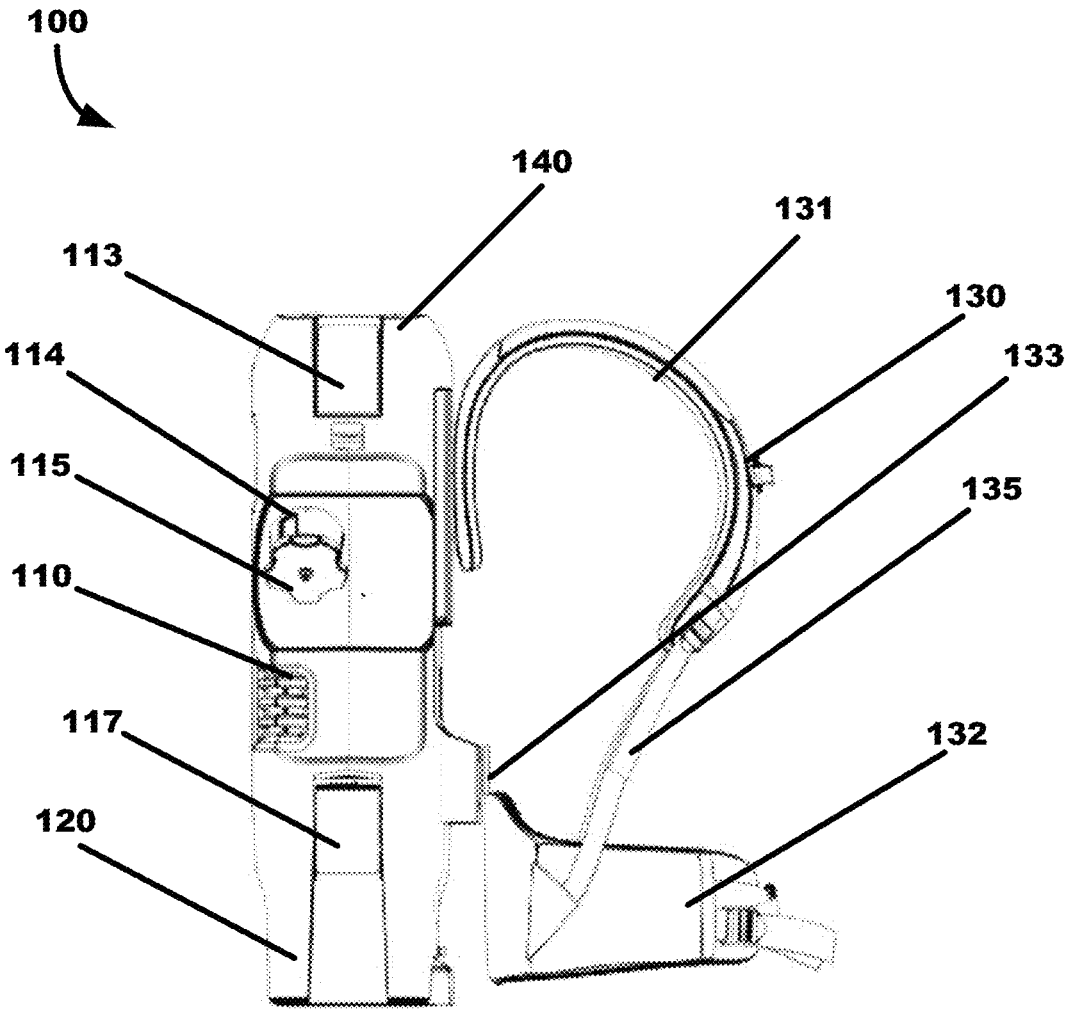
FIG. 2 illustrates a side view of the example portable backpack vacuum of FIG. 1.

As illustrated in FIG. 1, an example portable backpack vacuum 100 comprises an upper housing 110 that forms a vacuum body, a lower housing 120 that forms a dust tank and which is detachably connected to the upper housing 110, and a harness member 130 which facilitates support of the portable backpack vacuum 100 by a user. Although the illustrated embodiments show a portable backpack vacuum, this disclosure contemplates application as various industrial or residential appliances in which a user supports the appliance for a harness.

As illustrated in FIGS. 1 through 7, the upper housing 110, serving as vacuum body, includes an upper housing body 111 having a plurality of sidewalls defining an interior space 112 to receive one or more assemblies, sub-assemblies, components of the example portable backpack vacuum 100, including, but not limited to a vacuum motor (not illustrated) operable to generate negative or vacuum pressure during operation of the portable backpack vacuum 100. In accordance with one or more embodiments set forth, shown, and described herein, the upper housing body 111 may be composed of a durable material exhibiting high impact resistance. Such a material may comprise a 3D printable material. Such a 3D printable material may comprise, for example, a polymer material. Embodiments, however, are not limited thereto, and thus, this disclosure contemplates forming the upper housing body 111 using any suitable material that optimizes the performance of the example portable backpack vacuum 100 in a manner that falls within the spirit and scope of the principles of this disclosure.

The vacuum motor is in fluidic communication with a vacuum hose connector 114 serving as an air inlet arranged at a sidewall of the upper housing body 111. The vacuum hose connector 114 is in fluidic communication with a flexible suction hose member (not illustrated) that is operable to capture dust, debris, particles, etc. using the negative pressure generated by the vacuum motor. When the example portable backpack vacuum 100 is not in use (e.g., after a cleaning sequence has been conducted), the vacuum hose connector 114 may be covered by a vacuum hose connector cap 115.

A rear sidewall of the upper housing body 111 has a surface at an upper region thereof that forms a first connection interface 116 to facilitate connection with a pair of shoulder support members 131 of the harness member 130. The first connection interface 116 may include one or more holes to receive a corresponding mechanical fastener of the harness member 130 or a connection member 133, 134. The rear sidewall of has a surface at a lower region thereof that forms a second connection interface 118 that facilitates connection with a waist support member 132 of the harness member 130. The second connection interface 118 may include one or more holes to receive a corresponding mechanical fastener of the harness member 130 or one or more connection members 133, 134. Although the illustrated embodiment illustrates use of mechanical fasteners, this disclosure contemplates use of any suitable configurations that facilitate connection of the harness member 130 to the upper housing body 111 in a manner that optimizes the performance of the example portable backpack vacuum 100 and falls within the spirit and scope of the principles of this disclosure.

When the example portable backpack vacuum 100 is not in use (e.g., after a cleaning sequence has been conducted) and the lower housing body 121 is selectively detached and removed from its connection with the upper housing body 111, the peripheral bottom edge(s) 119 of the sidewalls of the upper housing body 111 may facilitate support of the upper housing body 111 on a support surface.

A cover member 140 having a cover member body 141 that is detachably connected via one or more upper latch members 113 to the upper housing 110 to enclose the interior space 112. In accordance with one or more embodiments set forth, shown, and described herein, the cover member body 141 may be composed of a durable material exhibiting high impact resistance. Such a material may comprise a 3D printable material. Such a 3D printable material may comprise, for example, a polymer material. Embodiments, however, are not limited thereto, and thus, this disclosure contemplates forming the cover member body 141 using any suitable material that optimizes the performance of the example portable backpack vacuum 100 in a manner that falls within the spirit and scope of the principles of this disclosure.

As illustrated in FIGS. 1, 2, 5, and 9, lower housing 120, serving as a tank or container, includes a lower housing body 121 having a plurality of sidewalls defining an interior space 122 to receive the dust, debris, particles, etc. captured by the flexible suction hose member. In accordance with one or more embodiments set forth, shown, and described herein, the lower housing body 121 may be composed of a durable material exhibiting high impact resistance. Such a material may comprise a 3D printable material. Such a 3D printable material may comprise, for example, a polymer material. Embodiments, however, are not limited thereto, and thus, this disclosure contemplates forming the lower housing body 121 using any suitable material that optimizes the performance of the example portable backpack vacuum 100 in a manner that falls within the spirit and scope of the principles of this disclosure.

Figure 3:
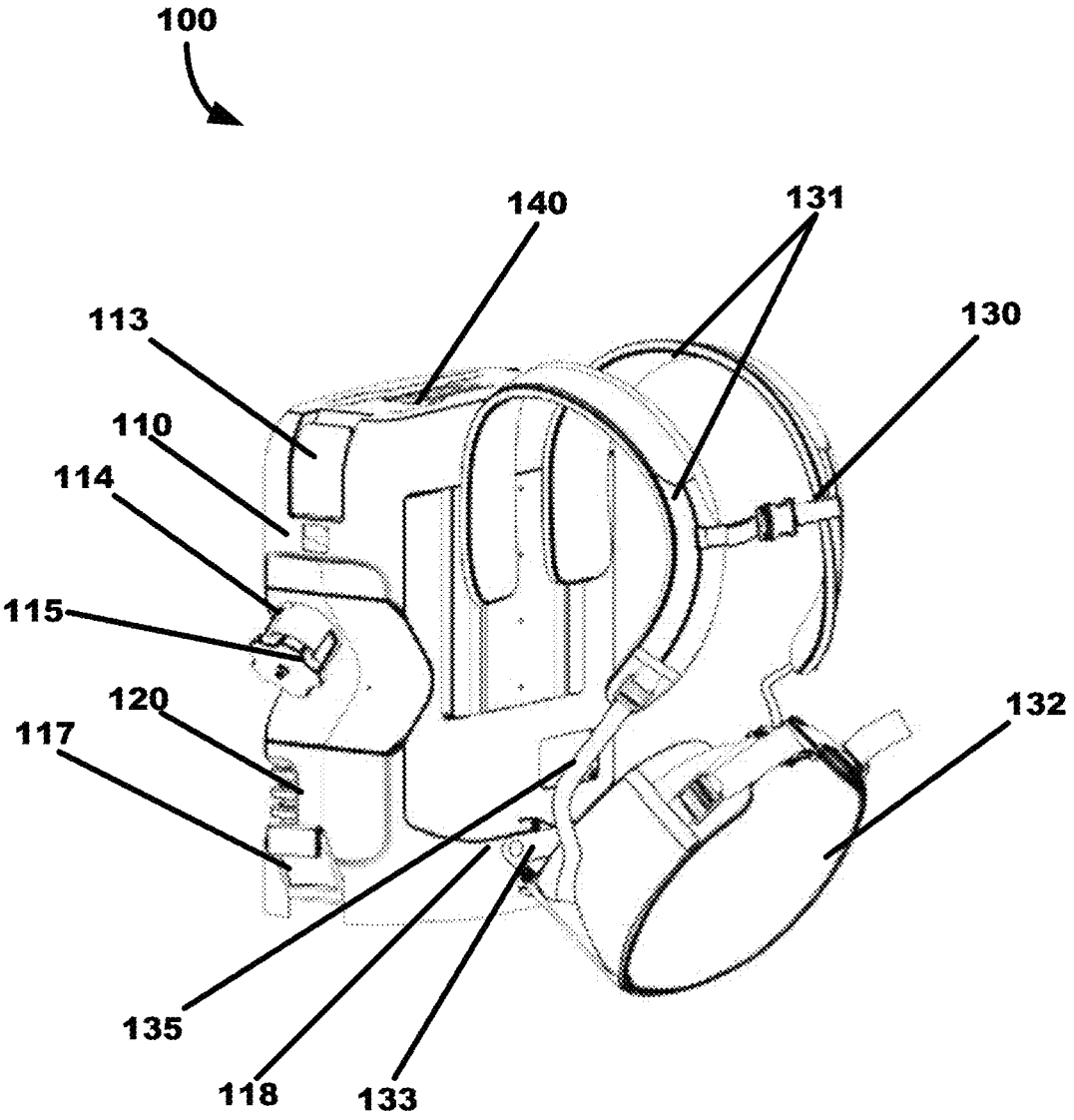
FIG. 3 illustrates a rear, perspective view of the example portable backpack vacuum of FIG. 1, with the lower housing removed.
Figure 4:
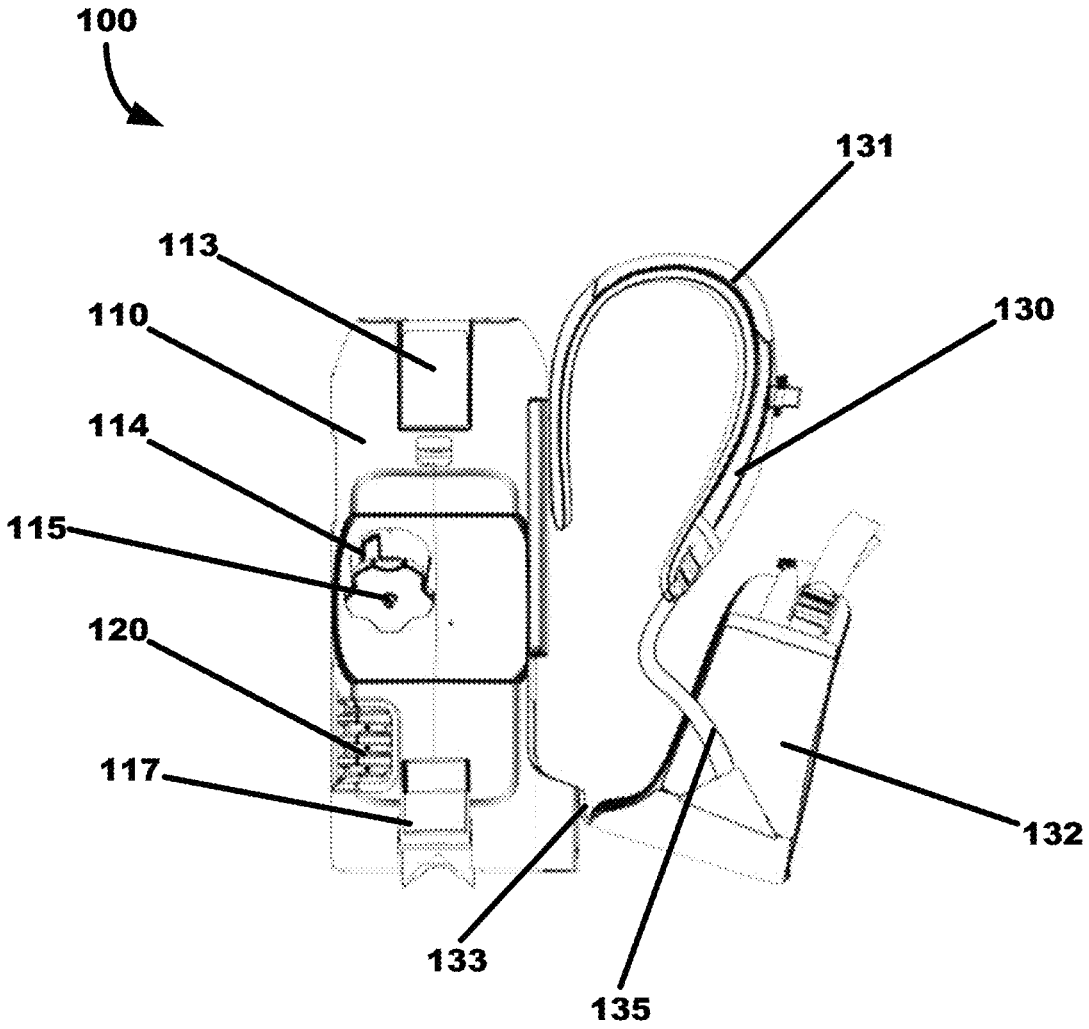
FIG. 4 illustrates a side view of the example portable backpack vacuum of FIG. 1, with the lower housing removed.
Figure 5:
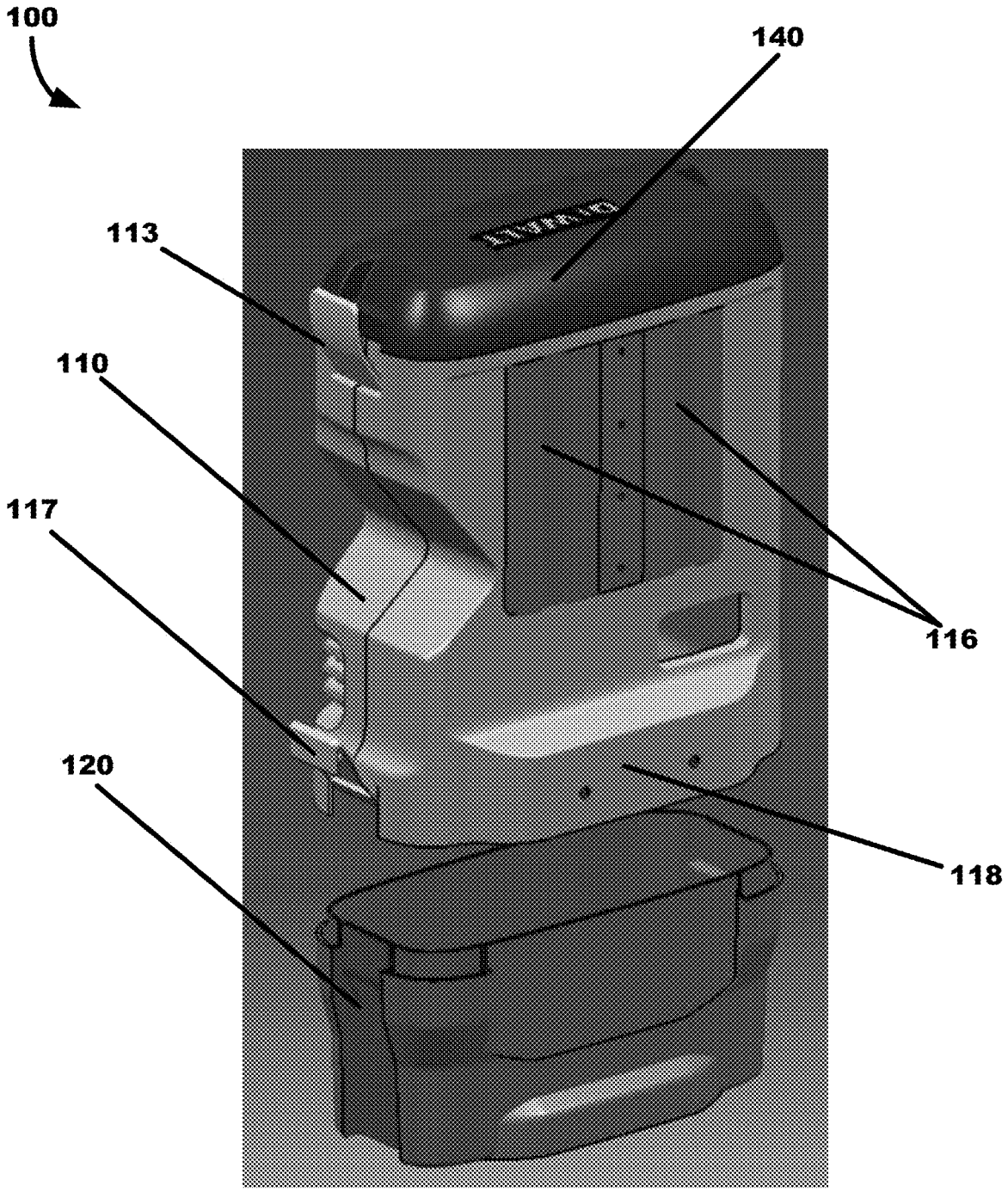
FIG. 5 illustrates an exploded view of the example portable backpack vacuum of FIG. 1.
Figure 6:
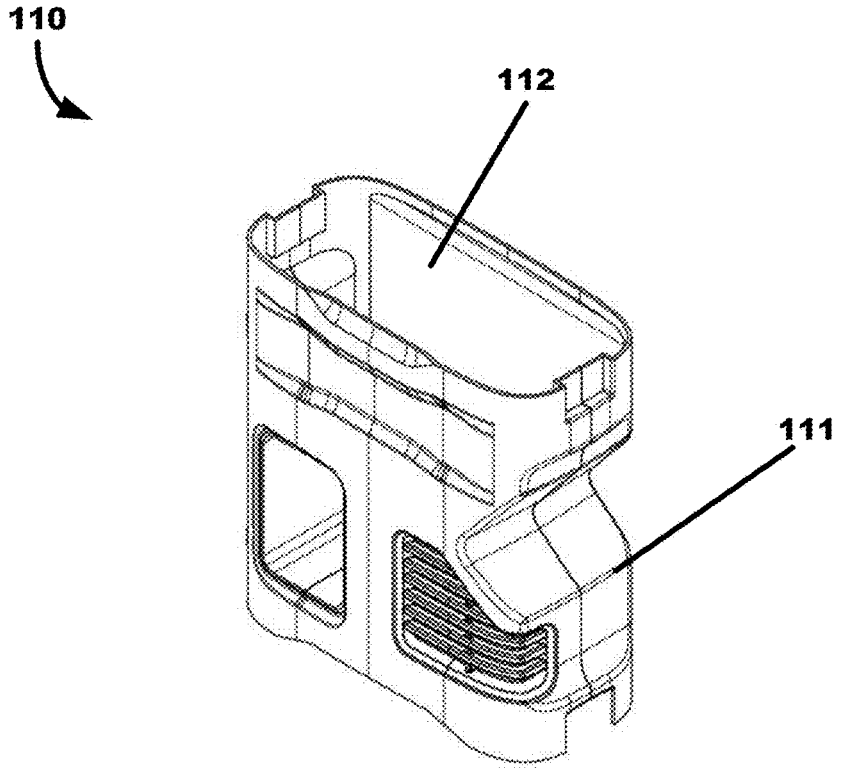
FIG. 6 illustrates a side, perspective view of an upper housing for an example portable backpack vacuum, in accordance with one or more embodiments set forth, described, and/or illustrated herein.
Figure 7:
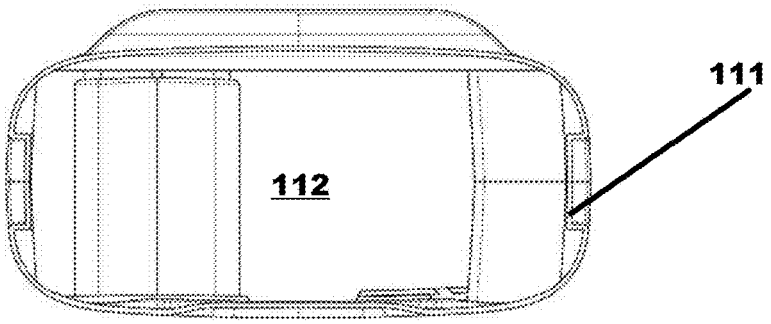
FIG. 7 illustrates a top view of the upper housing of FIG. 6.
Figure 8:
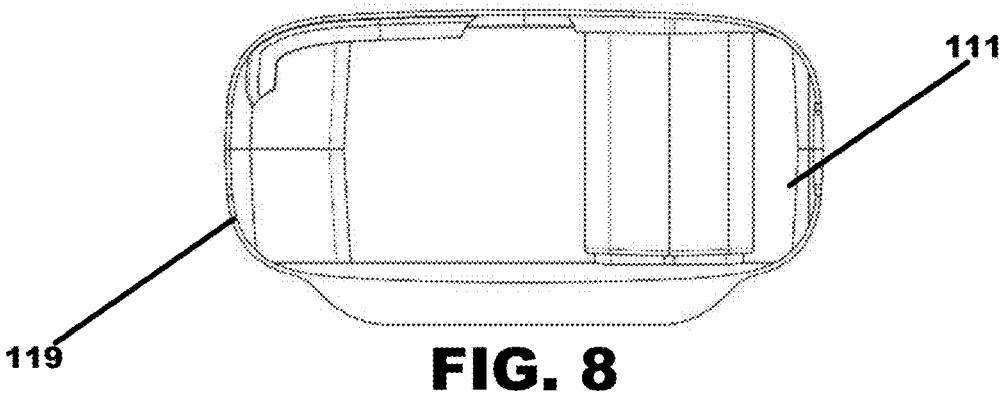
FIG. 8 illustrates a bottom view of the upper housing of FIG. 6.
Figure 9:
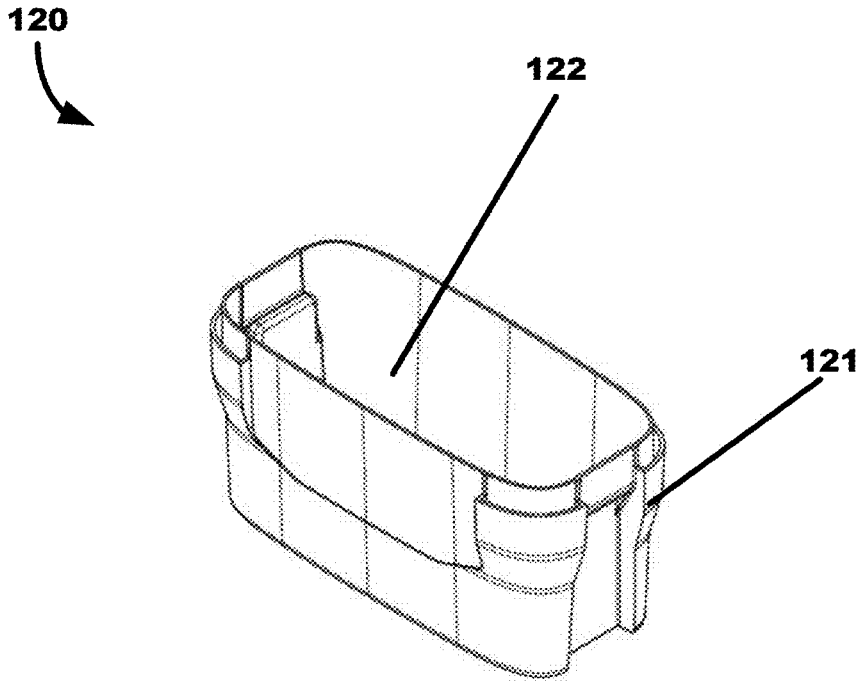
FIG. 9 illustrates a perspective view of a cover member for the upper housing of FIG. 5.
Figure 10:
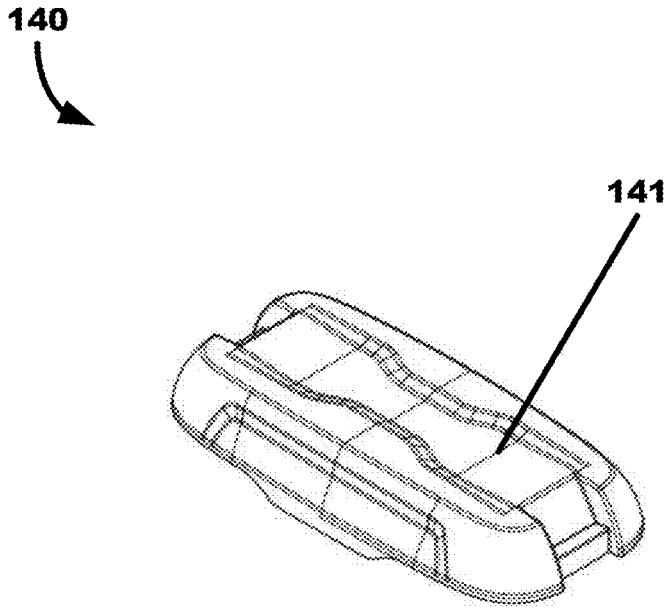
FIG. 10 illustrates a side, perspective view of a lower housing for an example portable backpack vacuum, in accordance with one or more embodiments set forth, described, and/or illustrated herein.

The lower housing body 121 is detachably connected via one or more lower latch members 117 to the upper housing 110 to enclose the interior space 122. When the example portable backpack vacuum 100 is not in use (e.g., after a cleaning sequence has been conducted), a user seeking to empty the interior space 122 of its contents, a user may selectively detach the lower housing body 121 from the upper housing body 111 by rotating the one or more lower latch members 117. As illustrated in FIGS. 3 through 5, the one or more lower latch members 117 are maintained in an upward orientation when the lower housing body 121 is selectively detached from the upper housing body 111.

As illustrated in FIGS. 1 through 4, the harness member 130 is operable to facilitate support of the portable backpack vacuum 100 by a user. The harness member 130 includes a pair of shoulder support members 131 that, when in operative use, are to extend over the shoulders of the user in a manner that facilitates at least partial support of the portable backpack vacuum 100. The shoulder support members 131 are connected to the upper housing body 111 at the first connection interface 116.

The harness member 130 also includes a waist support member 132 that, when in operative use, is to extend around the waist region of the user in a manner that facilitates at least partial support of the portable backpack vacuum 100. One or more strap members 135 are operable to connect the shoulder support members 131 to the waist support member 132. By virtue of the structural connection between the waist support member 132 and the upper housing body 111, the waist support member 132 defines a load path for loads induced when the portable backpack vacuum 100 is worn by the user. Moreover, when the user is not wearing the portable backpack vacuum 100, the structural connection facilitates the pivoting of the waist support member 132 to the stowed position.

The waist support member 132 is connected to the upper housing body 111 at the second connection interface 118 via the one or more connection members 133, 134. In particular, the connection via the one or more connection members 133, 134 facilitates rotation of the waist support member 132 between a deployed position and a stowed position. Rotation to the stowed position may occur, for example, when the lower housing 121 is detachably removed from its connection with the upper housing 111, and the user places the portable backpack vacuum 100 on a support surface to cause engagement of the waist support member 132 with a support surface. Such rotation by the waist support member 132 to a stowed position facilitates the support of the upper housing body 111 on a support surface at the peripheral bottom edge(s) 119. In this way, the portable backpack vacuum 100 may stand level on the support surface. The waist support member 132, during translation from the deployed position to the stowed position, moves between approximately 0 degrees to approximately 90 degrees relative to the support surface.

The one or more connection members are operable to pivotably connect the waist support member 132 of the harness member 130 at the second connection interface 118 of the upper housing 110 in a manner that facilitates rotation of the waist support member 132 between the deployed position and the stowed position.

In the illustrated example embodiment of FIGS. 1 through 4, the one or more connection members may comprise a flexible connector member 133 operable to cause rotation of the waist support member 132 relative to the upper housing 110 to the stowed position by engagement of the waist support member 132 with a support surface. The flexible connector member 133 may be fabricated using a flexible material. Such a material may include, but is not limited to a polymer, a metal, a natural fiber, synthetic fiber, a composite, or any combination thereof. Embodiments, however, are not limited thereto, and thus, this disclosure contemplates fabricating the flexible connector member 133 using any suitable material that optimizes the performance of the example portable backpack vacuum 100 in a manner that falls within the spirit and scope of the principles of this disclosure. In accordance with one or more example embodiments, the flexible connector member 133 may be integrally fabricated with the waist support member 132 so as to extend therefrom for connection to the upper housing 110. Alternatively, the flexible connector member 133 may be fabricated as an independent structural component for connection between the waist support member 132 and the upper housing 110.

Alternatively, the one or more connection members may comprise a hinge connector member 134 operable to facilitate rotation of the waist support member 132 relative to the upper housing 110 to the stowed position by engagement of the waist support member 132 with a support surface. The hinge connector member 134 may include one or more spring connector members operable to bias the waist support member 132 towards the stowed position after engagement of the waist support member 132 with the support surface. In one example embodiment, the hinge connector member 134 may comprise a 90-degree self-locking folding hinge. The hinge connector member 134 may be fabricated using a flexible material. Such a material may include, but is not limited to a polymer, a metal, a composite, or any combination thereof. Embodiments, however, are not limited thereto, and thus, this disclosure contemplates fabricating the hinge connector member 134 using any suitable material that optimizes the performance of the example portable backpack vacuum 100 in a manner that falls within the spirit and scope of the principles of this disclosure.

Alternatively, the one or more connection members may comprise a rotating joint member to connect the waist support member 132 to the upper housing 110. The rotating joint member may rotate to facilitate movement of the waist support member 132 to the stowed position by engagement of the waist support member 132 with a support surface.

The example and alternative embodiments described above may be combined in a variety of ways with each other. It should be noted that the present disclosure may, however, be embodied in many different forms and should not be construed as limited to the embodiments set forth herein; rather, the embodiments set forth herein are provided so that the disclosure will be thorough and complete, and will fully convey the scope of the disclosure to those skilled in the art. Furthermore, the steps and number of the various steps illustrated in the figures may be adjusted from that shown. The accompanying figures and attachments illustrate exemplary embodiments of the disclosure.

For definitional purposes and as used herein, "connected" or "attached" includes physical or electrical, whether direct or indirect, affixed or adjustably mounted. Thus, unless specified, "connected" or "attached" is intended to embrace any operationally functional connection.

As used herein, "substantially," "generally," "slightly" and other words of degree are relative modifiers intended to indicate permissible variation from the characteristic so modified. It is not intended to be limited to the absolute value or characteristic which it modifies but rather possessing more of the physical or functional characteristic than its opposite, and approaching or approximating such a physical or functional characteristic.

The terms "coupled," "attached," or "connected" may be used herein to refer to any type of relationship, direct or indirect, between the components in question, and may apply to electrical, mechanical, fluid, optical, electromagnetic, electro-mechanical or other connections. Additionally, the terms "first," "second," etc. are used herein only to facilitate discussion, and carry no particular temporal or chronological significance unless otherwise indicated. The terms "cause" or "causing" means to make, force, compel, direct, command, instruct, and/or enable an event or action to occur or at least be in a state where such event or action may occur, either in a direct or indirect manner.

Those skilled in the art will appreciate from the foregoing description that the broad techniques of the exemplary embodiments may be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. A portable backpack vacuum, comprising:

an upper housing;

a lower housing detachably connected to the upper housing;

a harness member including a waist support member to facilitate support of the portable backpack vacuum by a user, the waist support member being pivotably connected to the upper housing for rotation from a deployed position to a stowed position when the upper housing and the harness member are placed on a support surface by engagement of the waist support member with the support surface and when the lower housing is detachably removed from its connection with the upper housing; and one or more spring connector members operable to bias the waist support member towards the stowed position after the engagement of the waist support member with the support surface.

2. The portable backpack vacuum of claim 1, further comprising one or more connection members to pivotably connect the waist support member to the upper housing in a manner that facilitates rotation of the waist support member between the deployed position and the stowed position.

3. The portable backpack vacuum of claim 2, wherein each connection member in the one or more connection members comprises a flexible connector member operable to facilitate rotation of the waist support member to the stowed position by the engagement of the waist support member with the support surface.

4. The portable backpack vacuum of claim 2, wherein each connection member in the one or more connection members comprises a hinge connector member operable to facilitate rotation of the waist support member to the stowed position by engagement of the one or more hinge connector members with the support surface.

5. The portable backpack vacuum of claim 1, wherein in the deployed position, the waist support member is operable to define a load path for loads induced when the portable backpack vacuum is worn by the user.

6. The portable backpack vacuum of claim 1, wherein the waist support member, during translation from the deployed position to the stowed position, moves between approximately 0 degrees to approximately 90 degrees relative to the support surface.

7. A portable backpack vacuum, comprising:

a housing supporting a vacuum motor therein;

a harness member including a waist support member to facilitate support of the housing by a user, the waist support member being pivotably connected to the housing for rotation from a deployed position to a stowed position when the housing and the harness member are placed on a support surface by engagement of the waist support member with the support surface; and one or more spring connector members operable to bias the waist support member towards the stowed position after the engagement of the waist support member with the support surface.

8. The portable backpack vacuum of claim 7, further comprising a lower housing detachably connected to the housing, wherein when the lower housing is detached from the upper housing, the waist support member is rotated to the stowed position by the engagement of the waist support member with the support surface.

9. The portable backpack vacuum of claim 7, further comprising one or more connection members to pivotably connect the waist support member to the upper housing in a manner that facilitates rotation of the waist support member between the deployed position and the stowed position.

10. The portable backpack vacuum of claim 9, wherein each connection member in the one or more connection members comprises a flexible connector member operable to facilitate rotation of the waist support member to the stowed position by the engagement of the waist support member with the support surface.

11. The portable backpack vacuum of claim 9, wherein each connection member in the one or more connection members comprises a hinge connector member operable to facilitate rotation of the waist support member to the stowed position by engagement of the one or more hinge connector members with the support surface.

12. The portable backpack vacuum of claim 7, wherein in the deployed position, the waist support member is operable to define a load path for loads induced when the portable backpack vacuum is worn by the user.

13. A portable backpack vacuum, comprising:

a housing supporting a vacuum motor therein;

a harness member to be worn by a user, the harness member including a waist support member which defines a load path for loads induced when the portable backpack vacuum is worn by the user; and one or more connection members to pivotably connect the waist support member to the housing in a manner that facilitates rotation of the waist support member from a deployed position to a stowed position when the housing and the harness member are placed on a support surface by engagement of the waist support member with the support surface; and one or more spring connector members operable to bias the waist support member towards the stowed position after the engagement of the waist support member with the support surface.

14. The portable backpack vacuum of claim 13, further comprising a lower housing detachably connected to the housing, wherein when the lower housing is detached from the upper housing, the waist support member is rotated to the stowed position by the engagement of the waist support member with the support surface.

15. The portable backpack vacuum of claim 13, wherein each connection member in the one or more connection members comprises a flexible connector member operable to facilitate rotation of the waist support member to the stowed position by the engagement of the waist support member with the support surface.

16. The portable backpack vacuum of claim 13, wherein each connection member in the one or more connection members comprises a hinge connector member operable to facilitate rotation of the waist support member to the stowed position by engagement of the one or more hinge connector members with the support surface.

17. The portable backpack vacuum of claim 13, wherein the waist support member, during translation from the deployed position to the stowed position, moves between approximately 0 degrees to approximately 90 degrees relative to the support surface.

* * * * *